US010591161B2

(12) United States Patent
Super et al.

(10) Patent No.: US 10,591,161 B2
(45) Date of Patent: Mar. 17, 2020

(54) SYSTEMS AND METHODS FOR VALVE AND/OR COMBUSTION APPLICANCE CONTROL

(71) Applicant: Honeywell International Inc., Morris Plains, NJ (US)

(72) Inventors: Willem Super, Emmen (NL); Jos Praat, Borger (NL); Hans van der Mei, Oosterhesselen (NL); Frank van Prooijen, Sleen (NL)

(73) Assignee: Honeywell International Inc., Morris Plains, NJ (US)

( * ) Notice: Subject to any disclaimer, the term of this patent is extended or adjusted under 35 U.S.C. 154(b) by 98 days.

(21) Appl. No.: 16/004,385

(22) Filed: Jun. 9, 2018

(65) Prior Publication Data

US 2019/0376687 A1 Dec. 12, 2019

(51) Int. Cl.
*F23N 5/18* (2006.01)
*F23N 1/00* (2006.01)

(52) U.S. Cl.
CPC ..... *F23N 1/005* (2013.01); *F23N 5/187* (2013.01); *F23N 2005/185* (2013.01); *F23N 2025/04* (2013.01); *F23N 2041/02* (2013.01); *F23N 2041/08* (2013.01)

(58) Field of Classification Search
CPC ..... F23D 14/60; F16K 37/00; F23N 1/005
USPC ..... 431/12
See application file for complete search history.

(56) References Cited

U.S. PATENT DOCUMENTS

| | | | | |
|---|---|---|---|---|
| 3,049,300 | A | 8/1962 | Lewis et al. | |
| 3,486,834 | A | 12/1969 | Frey et al. | |
| 4,251,025 | A | 2/1981 | Bonne et al. | |
| 4,396,369 | A | 8/1983 | Kaessmann | |
| 4,792,089 | A | 12/1988 | Ballard | |
| 9,645,584 | B2 * | 5/2017 | Kucera | F23N 1/002 |
| 9,851,103 | B2 * | 12/2017 | Kucera | F23N 1/005 |
| 9,995,486 | B2 * | 6/2018 | Young | F23N 1/005 |
| 10,161,627 | B2 | 12/2018 | Doura et al. | |
| 10,203,049 | B2 * | 2/2019 | Kucera | F23N 1/002 |
| 10,288,282 | B2 * | 5/2019 | Senkyr | F23D 14/60 |
| 2001/0051321 | A1 | 12/2001 | La Fontaine | |
| 2011/0130941 | A1 | 6/2011 | Szepek et al. | |
| 2011/0269082 | A1 | 11/2011 | Schultz | |
| 2012/0222751 | A1 | 9/2012 | Okabe | |

(Continued)

OTHER PUBLICATIONS

International Search Report and Written Opinion for Application No. PCT/US2019/036090, 6 pages, dated Sep. 5, 2019.

*Primary Examiner* — Edelmira Bosques
*Assistant Examiner* — Nikhil P Mashruwala

(57) ABSTRACT

Methods and systems for controlling a gas valve assembly and/or combustion appliance may include identifying a flow rate of gas to a burner of a combustion appliance and determining if the flow rate is sufficient for a burner load of the combustion appliance. If the flow rate is sufficient for a burner load, a position of the valve member of the valve assembly and/or the burner load may be adjusted such that the flow rate of gas meets a target flow rate of gas for the current burner load. If the flow rate is insufficient to meet the current burner load, the valve member of the valve assembly may be positioned in a fully open position to at least partially meet the current burner load. If the flow rate is below a minimum flow rate threshold, the valve member may be moved to a fully closed position.

16 Claims, 9 Drawing Sheets

(56) References Cited

U.S. PATENT DOCUMENTS

| | | | | |
|---|---|---|---|---|
| 2013/0045451 | A1 | 2/2013 | Shellenberger et al. | |
| 2015/0045971 | A1* | 2/2015 | Endel | G05D 7/0629 700/282 |
| 2015/0338091 | A1* | 11/2015 | Deng | F23D 14/28 431/280 |
| 2016/0076768 | A1 | 3/2016 | Kusachi et al. | |
| 2017/0082320 | A1 | 3/2017 | Wang et al. | |
| 2017/0204990 | A1 | 7/2017 | Kucera et al. | |
| 2017/0370577 | A1 | 12/2017 | Senkyr et al. | |
| 2018/0372323 | A1 | 12/2018 | Griffiths | |

* cited by examiner

SYSTEMS AND METHODS FOR VALVE AND/OR COMBUSTION APPLICANCE CONTROL

TECHNICAL FIELD

The present disclosure relates generally to systems and methods for controlling a valve assembly of a combustion appliance.

BACKGROUND

Flow rates of fuel to a combustion appliance can affect the efficiency and emissions of the combustion appliance. Examples of combustion appliances can include furnaces, water heaters, boilers, direct/in-direct make-up air heaters, power/jet burners and any other residential, commercial or industrial combustion appliance. In many cases, a combustion appliance can be modulated over a plurality of burner loads, with each burner load requiring a different flow rate of fuel resulting in a different heat output. At higher burner loads, more fuel and more air are typically provided to the burner, and at lower burner loads less fuel and less air are typically provided to the burner.

It can be a challenge to provide a desired gas flow to the burner when the inlet gas pressure of the gas source changes over time. To address this, some systems provide a low gas pressure switch and a high gas pressure switch. When the gas pressure of the gas source falls below a low gas pressure threshold, the low gas pressure switch switches and closes the gas valve, thereby shutting down the burner of the combustion appliance. Likewise, when the gas pressure of the gas source rises above a high gas pressure threshold, the high gas pressure switch switches and closes the gas valve, thereby shutting down the burner of the combustion appliance. Shutting down the burner of the combustion appliance because of pressure changes in the gas pressure of the gas source is highly undesirable. What would be desirable are improved systems and methods for operating a combustion appliance even when the inlet gas pressure of the gas source changes substantially over time.

SUMMARY

The present disclosure provides improved systems and methods for operating a combustion appliance even when the inlet gas pressure of the gas source changes substantially over time.

In one example of the disclosure, a modulating gas valve for controlling a flow of gas to a burner of a combustion appliance to service a modulating burner load is provided. The gas valve may include a valve body defining a gas flow path from an inlet to an outlet, a valve (e.g., a valve member) situated in the gas flow path for modulating the gas flow through the gas flow path. The valve may have a full closed position, a fully opened position, and a plurality of intermediate positions between the fully closed position and the fully opened position. The gas valve may further include an actuator, a sensor, and a controller operatively coupled to the sensor and the actuator. The actuator may be configured to move the valve between the fully closed position, the fully opened position, and the plurality of intermediate positions. The sensor may be configured to sense a measure related to a gas inlet pressure of gas supplied to the gas valve. The controller may be configured to: (1) identify a first condition that corresponds to when a flow of gas to the burner with the valve at the fully open position would fall below a first minimum flow threshold based at least in part on the measure related to a gas pressure of gas supplied to the gas valve sensed by the sensor, and when the first condition is identified, move the valve via the actuator to the closed position and/or send a signal to have a different valve (e.g., a safety shut off valve or other suitable valve) moved to a closed position thereby shutting off gas flow to the burner; (2) identify a second condition that corresponds to when the flow of gas to the burner with the valve at the fully open position would fall below a second minimum flow threshold but above the first minimum flow threshold based at least in part on the measure related to a gas pressure of gas supplied to the gas valve sensed by the sensor, and when the second condition is identified, modulate the valve via the actuator to supply the burner with a gas flow that at least partially satisfies the modulating burner load; (3) identify a third condition that corresponds to when a flow of gas to the burner with the valve at a predetermined open position would fall above a first maximum flow threshold based at least in part on the measure related to a gas pressure of gas supplied to the gas valve sensed by the sensor, and when the third condition is identified, move the valve via the actuator to the closed position and/or send a signal to have a different valve (e.g., a safety shut off valve or other suitable valve) moved to a closed position thereby shutting off gas flow to the burner; and/or (4) identify a fourth condition that corresponds to when the flow of gas to the burner with the valve at the predetermined open position would fall above a second maximum flow threshold but below the first maximum flow threshold based at least in part on the measure related to a gas pressure of gas supplied to the gas valve sensed by the sensor, and when the fourth condition is identified, modulate the valve via the actuator to supply the burner with a gas flow that satisfies the modulating burner load.

Another example, a modulating gas valve for controlling a flow of gas to a burner of a combustion appliance may include a valve, a valve actuator, a flow sensor, and a controller. The valve may be configured to control a flow of gas along a gas path and the valve actuator may be configured to modulate a position of the valve to modulate the flow of gas along the gas path. The flow sensor may be configured to sense a measure related to a flow rate of the flow of gas along the gas path. The controller may be configured to determine a position of the valve, determine a flow rate of the flow of gas along the gas path based at least in part on the measure related to the flow rate of the flow of gas along the gas path, and output a control signal to modulate the position of the valve based on the position of the valve and the flow rate of the flow of gas along the gas path to attempt to provide a desired flow of gas to the burner to meet a current burner load. In some cases, when the flow rate of the flow of gas along the gas path is not sufficient to provide the desired flow of gas to the burner with the position of the valve in a fully open position, but the flow rate of the flow of gas along the gas path is greater than a predetermined minimum flow of gas, the controller may be configured to output a control signal that modulates the position of the valve to the fully open position to at least partially satisfy the current burner load. Likewise, when the flow rate of the flow of gas along the gas path is higher than a predetermined maximum flow of gas with the position of the valve in a fully open position, but the flow rate of the flow of gas along the gas path is less than the predetermined maximum flow of gas with the position of the valve in a less than fully open position, the controller may be configured to output a control signal that modulates the position of the valve to an intermediate position that meets the current burner load.

In another example, a method for controlling a modulating gas valve for supplying a flow of gas to a burner of a combustion appliance may include determining a measure related to gas flow rate of gas passing through the modulating gas valve based on a signal from a sensor. The method may further include determining when a desired gas flow rate of gas can be provided by the gas valve to meet a current burner load of the combustion appliance, and when so, modulating the gas valve to meet the current burner load of the combustion appliance. Further, the method may include determining when a desired gas flow rate of gas can be provided by the gas valve to only partially meet the current burner load of the combustion appliance even with the gas valve in a fully opened position while still providing at least a predetermined minimum gas flow rate to the burner, and when so, modulating the gas valve to partially meet the current burner load of the combustion appliance. In some cases, the method may include determining when a desired gas flow rate of gas can be provided by the gas valve to only partially meet the current burner load of the combustion appliance even with the gas valve in a fully open position but not while still providing at least the predetermined minimum gas flow rate to the burner, and when so, modulating the gas valve to a fully closed position.

In some cases, the method may include determining when a desired gas flow rate of gas can be provided by the gas valve to meet the current burner load of the combustion appliance but not while keeping the gas flow rate below a predetermined maximum gas flow rate to the burner, and when so, modulating the gas valve to meet the current burner load of the combustion appliance. In some cases, the method may include determining when a desired gas flow rate of gas can be provided by the gas valve to meet the current burner load of the combustion appliance but not while keeping the gas flow rate below the predetermined maximum gas flow rate to the burner, and when so, modulating the gas valve to a fully closed position.

The preceding summary is provided to facilitate an understanding of some of the innovative features unique to the present disclosure and is not intended to be a full description. A full appreciation of the disclosure can be gained by taking the entire specification, claims, drawings, and abstract as a whole.

BRIEF DESCRIPTION OF THE DRAWINGS

The disclosure may be more completely understood in consideration of the following description of various illustrative embodiments in connection with the accompanying drawings, in which.

Figure 1:
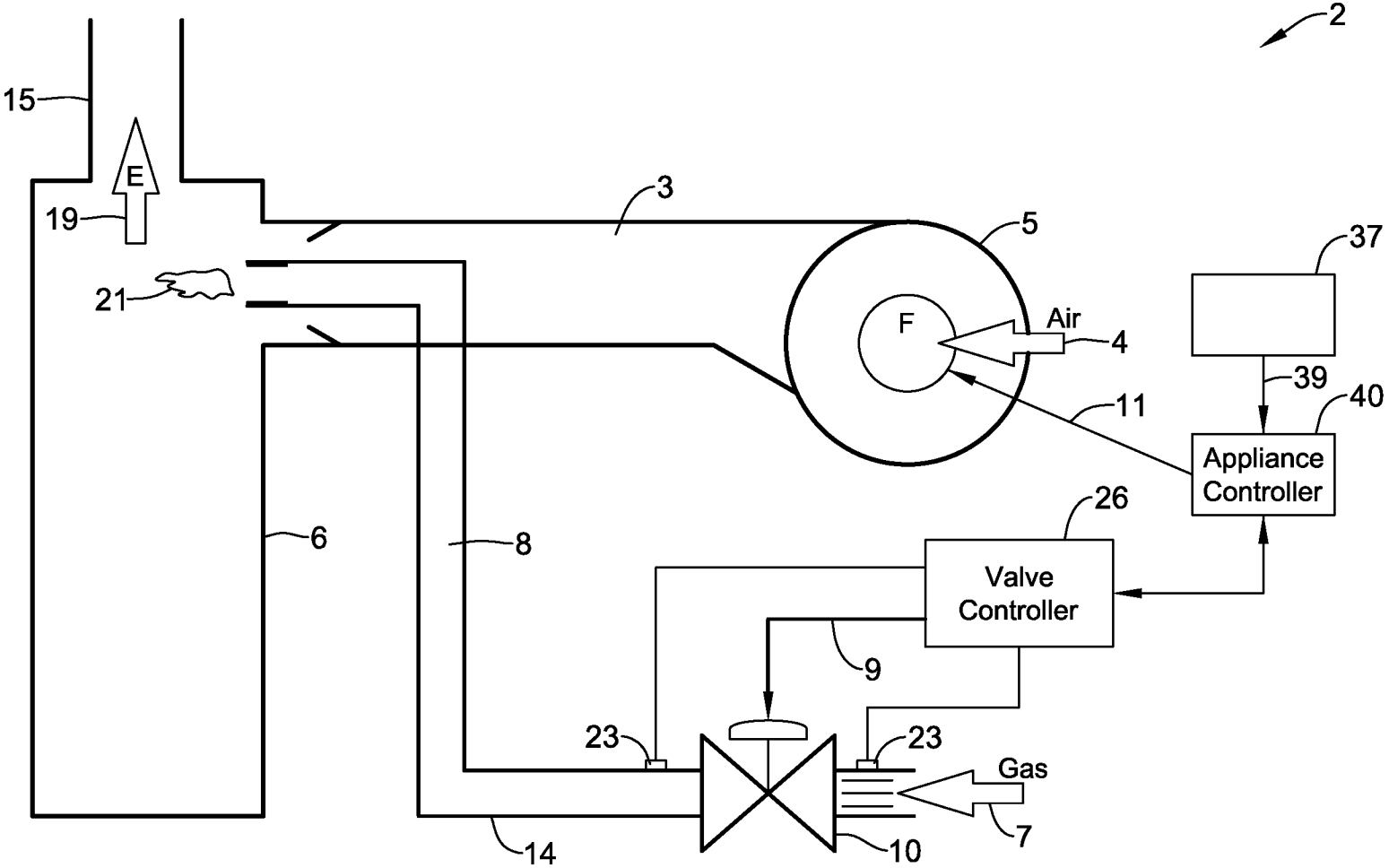
FIG. 1 is a schematic diagram of an illustrative burner control system.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements throughout the several views. The detailed description and drawings show several illustrative embodiments which are meant to be illustrative of the claimed disclosure.

Valves may be added to fluid supply lines including, but not limited to, gas valves added to supply lines configured to provide fuel to a burner of a combustion appliance. In some cases, a gas valve assembly may be configured to monitor and/or control various operations including, but not limited to, supplied gas pressure, regulated gas pressure, gas flow and/or gas consumption, valve position, electronic cycle counting, overpressure diagnostics, high gas pressure and low gas pressure detection, valve proving system tests, valve leakage tests, proof of valve closure tests, diagnostic communications, and/or any other suitable operation as desired. In some cases, a gas valve assembly may be configured to facilitate control of a valve position and/or control of a burner load or firing rate of a combustion appliance in real or near real time based on feedback from one or more sensors sensing measures related to the operation of the valve assembly such as gas flow, gas pressure, and/or any other suitable measure related to the operation of the valve assembly.

In one approach, a gas pressure of fuel supplied to the valve assembly may be monitored with a low pressure switch that causes a valve of the valve assembly to close when the pressure of the supplied fuel goes below a low threshold level. The pressure of fuel may also be monitored with a high pressure switch that causes the valve of the valve assembly to close when a supplied pressure goes above a high threshold level. However, closing the valve and shutting down the downstream burner of a combustion appliance whenever the gas pressure goes out of a defined range, regardless of the current burner load, can be undesirable. In an improved approach, one or more mass flow sensors and/or other suitable sensors in addition to a valve position sensor may be used in addition to or as an alternative to low and/or high pressure switches, to facilitate operating the combustion appliance even when the gas pressure of the fuel that is supplied to the valve assembly is insufficient to meet the fuel requirements of the current burner load and/or exceeds the fuel requirements of the current burner load when the valve of the valve assembly is in the fully open position, as further described herein.

FIG. 1 is schematic diagram of an illustrative burner control system 2 (e.g., a combustion appliance) having a fuel and air mixture where an air/fuel ratio is adjustable. The burner control system 2 may have an air supply channel 3 for supplying air 4 into a chamber 6 (e.g., a combustion chamber or other suitable chamber) of a burner with a fan 5 at one end of the channel 3. At the other end of channel 3, the supplied air 4 may enter the chamber 6 of the burner. Fuel 7 (e.g., gas or other suitable fuel) may be injected under pressure, via a fuel channel 8, into the airflow at a mixing location in the air supply channel 3 and/or in the chamber 6 of the burner. The fuel channel 8 may be connected to a gas valve assembly 10. The burner control system 2 depicted in FIG. 1 is only illustrative, and it is contemplated that the burner control system 2 may have one or more additional or alternative components and/or configurations, as desired.

A valve controller 26 may be in communication with the valve assembly 10 or may be part of the valve assembly 10. In some cases, the valve controller 26 may provide a signal 9 to the valve assembly 10 to adjust a position of a valve (e.g., valve member) of the valve assembly 10. In some cases, the valve assembly 10 may be motorized and may be configured to open and/or close the valve thereof incrementally according to the signal 9. For example, the valve controller 26 may send the signal 9 to the valve assembly 10 to open the valve when more fuel is needed and may send the signal 9 to the valve assembly 10 to close the valve when less fuel is needed.

The valve controller 26 may be in communication with one or more sensors 23. As depicted in FIG. 1, a sensor 23 may be configured to sense a measure related to a fluid upstream of a valve of the valve assembly 10 (e.g., an inlet flow rate or inlet pressure of fluid supplied to the valve assembly 10) and/or sense a measure related to a fluid downstream of a valve of the valve assembly 10 (e.g., an outlet flow rate or outlet pressure of fluid regulated to a combustion appliance). Although not depicted as being part of the valve assembly 10 in FIG. 1, the sensors 23 may be at least partially within a valve body of the valve assembly 10. Further, the sensors may be part of and/or may include pressure sensor assemblies (e.g., pressure sensor assemblies 24 or other suitable pressure sensor assemblies). Alternatively or in addition, one or more sensors 23 may be a flow rate sensor (e.g., a flow rate sensor using an anemometer, a differential pressure sensor with upstream and downstream pressure taps, and/or other suitable flow rate sensor), which may sense a flow rate of fluid passing the flow rate sensor.

In some cases, the valve controller 26 may be connected to or in communication with a combustion appliance controller 40 (e.g., a burner controller or other suitable appliance controller), where the valve controller 26 and the combustion appliance controller 40 may be configured to send control signals, diagnostic signals, data signals, or other suitable signals to one another. The combustion appliance controller 40 may be connected to or in communication with the fan 5, which may be varied in speed according to a signal 11 from the combustion appliance controller 40 to vary a flow of air 4 through the air supply channel 3 and establish a burner load or firing rate. In such cases, the valve controller 26 may be configured to receive a control signal (electrical and/or pneumatic) indicating a set speed of the fan 5 from the combustion appliance controller 40, and adjust the position of the valve of the valve assembly 10 to produce a desired air/fuel ratio at the combustion chamber. When so provided, changing speeds of the fan 5 may increase or decrease the burner load (e.g. firing rate) of the burner of the combustion appliance. In one example, the current burner load may be set to match a current thermal load of a building that is heated by the combustion appliance. A thermostat 37 or other building controller may sense the current conditions inside the building (and in some cases outside the building), and in response, provide a control signal 39 to the combustion appliance controller 40, which sets the current burner load of the combustion appliance. The combustion appliance controller 40 may, for example, change the speed of the fan 5 via signal 11 to establish a desired burner load or firing rate.

Alternatively or in addition, the valve controller 26 may be in direct communication with or directly connected to the fan 5 (e.g., without the combustion appliance controller 40 as an intermediary). In such configurations, the fan 5 may be varied in speed according to a signal from the valve controller 26 to vary a flow of air 4 through the air supply channel 3 and establish a burner load or firing rate. In this instances, the valve controller 26 may include the function of the combustion appliance controller 40.

In some cases, the air/fuel ratio of the burner control system 2 may be controlled to achieve a desired measure of combustion constituents 19 exiting the chamber 6. In some cases, a combustion sensor (not shown) may be mounted at an exhaust port 15 of the chamber 6 to provide a signal (e.g., via a wired or wireless communication path) to the valve controller 26 (or combustion appliance controller 40), where the signal may indicate a measure and/or other information of combustion constituents 19 emanating from a flame 21. When included, the combustion sensor may be permanently or removably mounted at or adjacent the exhaust port.

Figure 2:
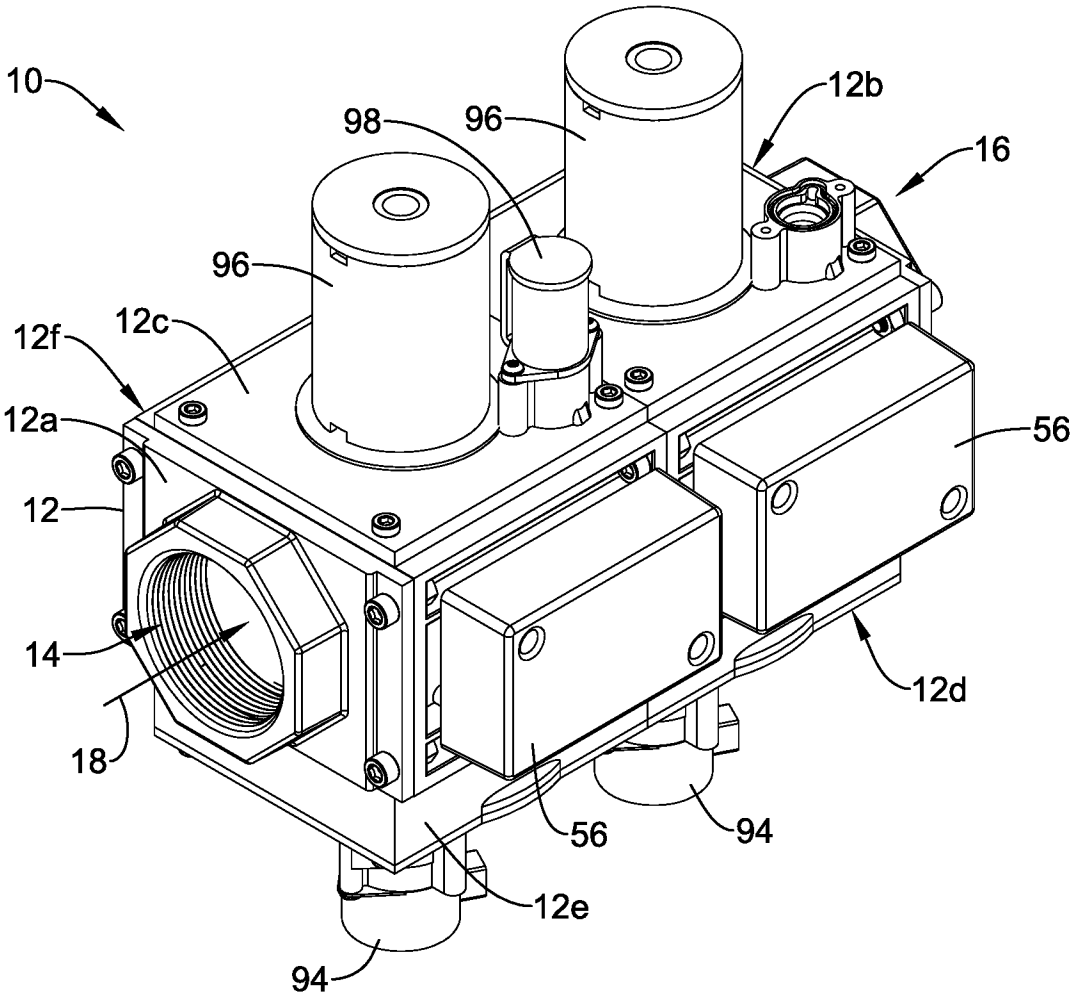
FIG. 2 is a schematic perspective view of an illustrative gas valve assembly.
Figure 3:
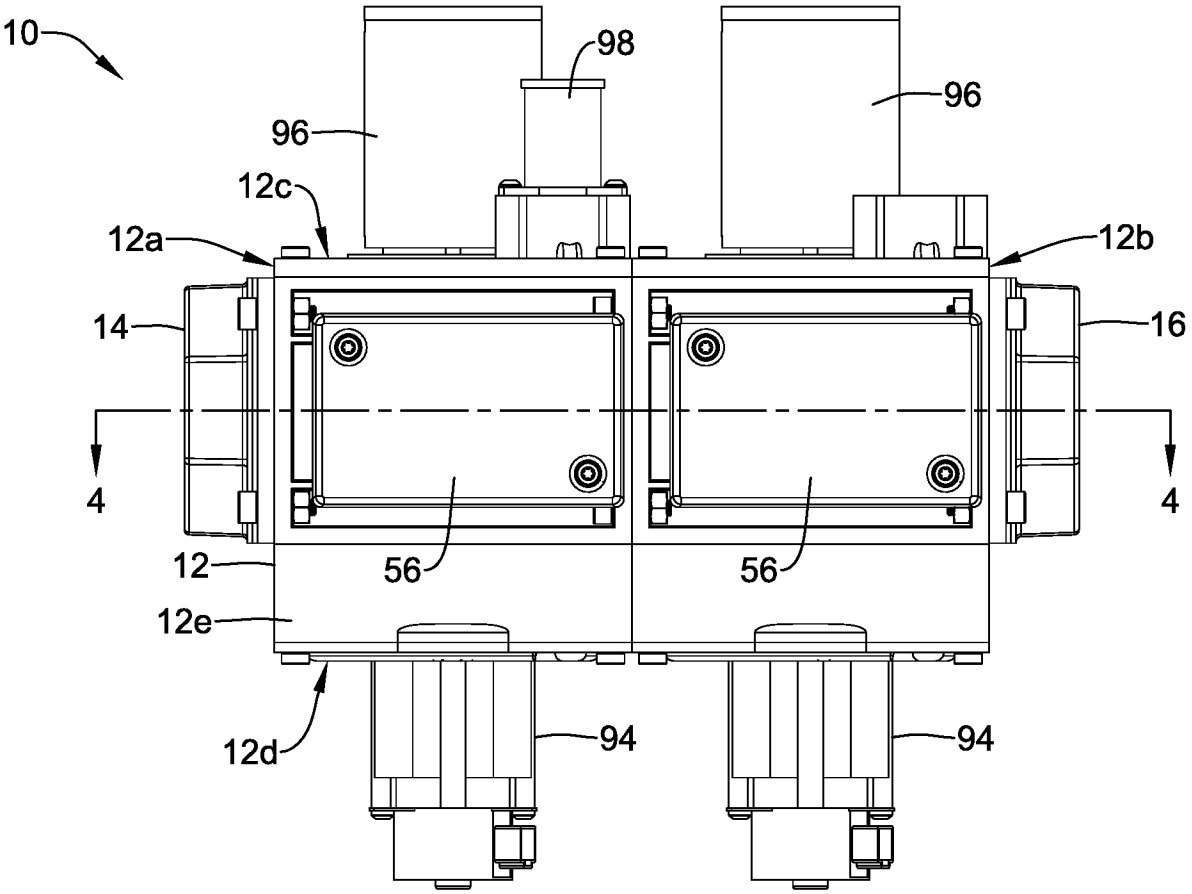
FIG. 3 is a schematic side view of the illustrative gas valve assembly of FIG. 2.

FIG. 2 is a schematic perspective view of an illustrative valve assembly 10 for controlling gas flow to a combustion appliance or other similar or different device. In the illustrative embodiment, the gas valve assembly 10 may include a valve body 12, which may generally be a six sided shape or may take on other suitable shapes as desired, and may be formed as a single body or may be multiple pieces connected together. As shown, the valve body 12 may be a six-sided shape having a first end 12*a*, a second end 12*b*, a top 12*c*, a bottom 12*d*, a back 12*e* and a front 12*f*, as depicted in the views of FIGS. 2 and 3. The terms top, bottom, back, front, left, and right are relative terms used merely to aid in discussing the drawings, and are not meant to be limiting in any manner.

Figure 4:
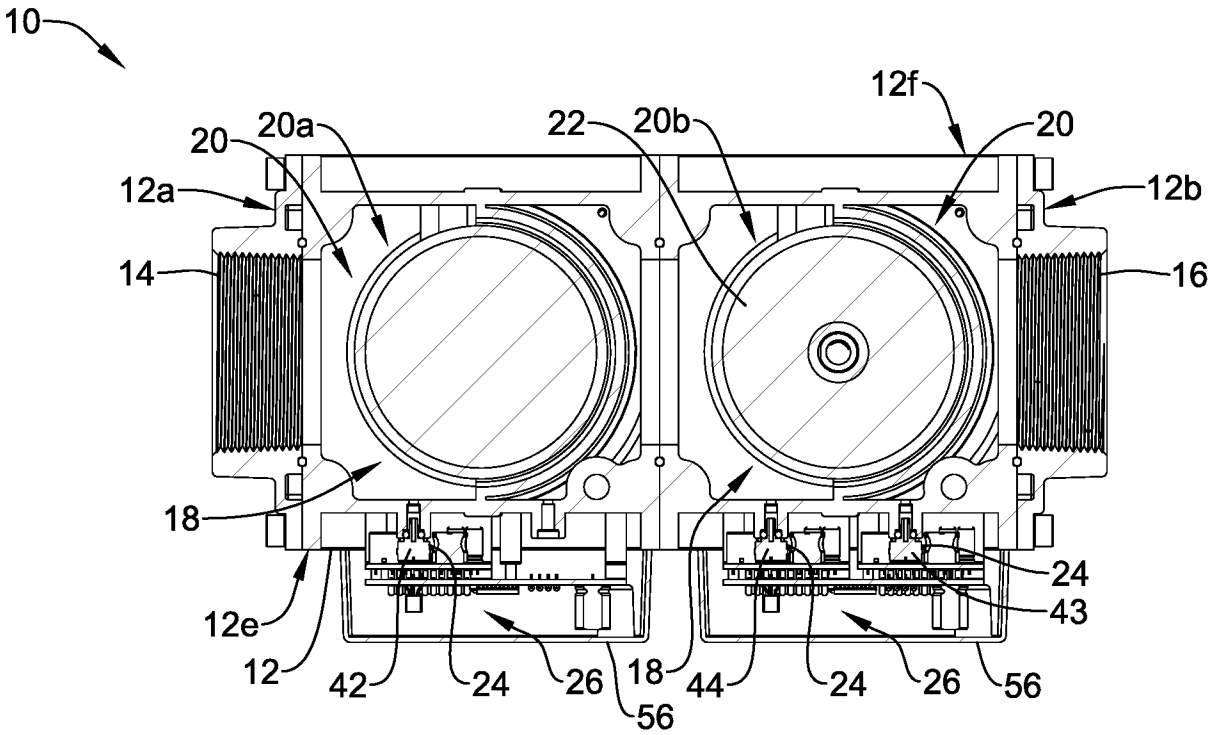
FIG. 4 is a cross-sectional view of the illustrative gas valve assembly of FIG. 2, taken along line 4-4 of FIG. 3.

The illustrative valve body 12 may include an inlet port 14, an outlet port 16 and a fluid path or fluid channel 18 (e.g., a gas flow path or other suitable path or channel) extending between the inlet port 14 and the outlet port 16. Further, the valve body 12 may include one or more gas valve ports 20 (e.g., a first valve port 20*a* and a second valve port 20*b*, shown in FIG. 4) positioned or situated in the fluid channel 18, one or more fuel or gas valve member(s) 22 (e.g., as shown in FIG. 4) sometimes referred to as valve sealing member(s)) moveable within the gas valve ports 20 (e.g., a first valve sealing member within the first valve port 20*a* and a second valve sealing member within the second valve port 20*b*, though not explicitly shown), one or more pressure sensor assemblies 24 (as shown in FIG. 4, for example), one or more position sensors (not explicitly shown), one or more mass flow sensors (e.g., which may include a thermal anemometer and/or may have one or more other suitable configurations; not explicitly shown), and/or one or more valve controllers 26 (as shown in FIG. 4, for example) affixed relative to or coupled to the valve body 12 and/or in electrical communication (e.g., through a wired or wireless connection) with pressure sensor assemblies 24, position sensor(s), and/or gas valve members.

The valve assembly 10 may further include one or more actuators for operating moving parts therein. For example, valve assembly 10 may have actuators including, but not limited to, one or more stepper motors 94 (shown as extending downward from the bottom 12*d* of valve body 12 in FIG. 2), one or more solenoids 96 (shown as extending upward from the top 12*c* of valve body 12 in FIG. 2), and one or more servo actuators 98 (e.g., a servo actuator 98 is shown as extending upward from the top 12*c* of valve body 12 in FIGS. 2 and 3, where a second servo valve has been omitted), where the servo actuator 98 may be a 3-way auto-servo actuator or may be any other type of servo actuator. In one illustrative embodiment, the one or more solenoids 96 may control whether the one or more gas valve ports 20 are opened or closed. The one or more stepper motors 94 may determine the opening size of the gas valve ports 20 when the corresponding gas valve sealing member is opened by the corresponding solenoid 96 (e.g., the stepper motors 94 may adjust a position of the valve members to one or more intermediate positions between a fully opened position and a fully closed position). In some cases, the one or more stepper motors 94 may not be provided when, for example, the valve assembly 10 is not a "modulating" valve that allows more than one selectable flow rate to flow through the valve when the valve is opened.

The one or more actuators and/or motors 94, 96, 98 may be in electrical communication (e.g., through a wired or wireless connection) with the one or more valve controllers 26. In one example, the valve controller 26 may provide control signals to the stepper motors 94 and determine a position of a valve member based on the control signals provided to the stepper motors 94 to provide an indication of a flow restriction in the fluid channel 18. In some cases, the valve controller 26 or other controller may compare an expected flow rate of fluid through the fluid channel 18 based on an indication of the flow restriction (e.g. position of the valve) and compare the expected flow rate of fluid to a sensed, calculated or determined flow rate of fluid in the fluid channel 18 from sensed measurements using one or more sensors (e.g., pressure sensors 24, mass flow sensors, and/or other suitable sensors). If they are similar, the expected position of the valve and/or the proper functioning of the flow sensor may be confirmed.

As shown, the valve body 12 may include one or more sensor and electronics compartments 56, which in the illustrative embodiment, extend from the back side 12*e* as depicted in FIGS. 2 and 3. The sensor and electronics compartments 56 may be coupled to or may be formed integrally with the valve body 12, and may enclose and/or contain at least a portion of the valve controllers 26, pressure sensor assemblies 24, flow sensors, and/or electronics required for operation of valve assembly 10 as described herein. Although the compartments 56 may be illustratively depicted as separate structures, the compartments 56 may be a single structure part of, extending from, and/or coupled to the valve body 12.

FIG. 4 illustrates a cross-sectional view of the illustrative valve assembly 10 taken at line 4-4 in FIG. 3. In the illustrative embodiment, the one or more fluid valve ports 20 may include a first gas valve port 20*a* and a second gas valve port 20*b* situated along and/or in communication with the fluid channel 18. This is a double-block valve design. Within each gas valve port 20, a gas valve member (e.g., the gas valve sealing member 22 in the second gas valve port 20*b*, as shown in FIG. 4) may be situated in the fluid channel 18 and may be positioned (e.g., concentrically or otherwise) about an axis, rotatable about the axis, longitudinally and axially translatable, rotationally translatable, and/or otherwise selectively movable between a first position (e.g., an opened or closed position) and a second position (e.g., a closed or opened position) within the corresponding valve port 20. Movement of the valve sealing member may open and close the valve port 20.

It is contemplated that the valve sealing member (e.g., a valve) may include one or more of a valve disk, a valve stem and/or valve seal for sealing against a valve seat situated in the fluid channel 18 and/or other similar or dissimilar components facilitating a seal. Alternatively, or in addition, the valve sealing member may include structural features and/or components of a gate valve, a disk-on-seat valve, a ball valve, a butterfly valve and/or any other type of valve configured to operate from a closed position to an opened position and back to a closed position. An opened position of a valve sealing member may be any position that allows fluid to flow through the respective gas valve port 20 in which the valve sealing member is situated, and a closed position may be when the valve sealing member forms at least a partial seal at the respective valve port 20. The valve sealing member may be operated through any technique. For example, the valve sealing member may be operated through utilizing a spring, an actuator to effect movement against the spring, and, in some cases, a position sensor to sense a position of the valve sealing member.

The valve actuator(s), as discussed above, may be any type of actuator configured to operate the valve sealing member by actuating the valve sealing member from the closed position to an opened position and then back to the closed position during each of a plurality of operation cycles during a lifetime of the gas valve assembly 10 or of the actuator. In some cases, the actuator may actuate the valve sealing member from the closed position to the opened position, and then a spring or the like may return the valve sealing member from the open position to the closed position. In other cases, the actuator may actuate the valve sealing member from the open position to the closed position, and then a spring or the like may return the valve sealing member from the closed position to the open position.

In some cases, the valve actuator may be a solenoid actuator, a hydraulic actuator, magnetic actuators, electric motors including stepper motors, pneumatic actuators, and/or other similar or different types of actuators, as desired. While not explicitly shown in FIG. 4, the valve actuators may be configured to selectively move the valves or valve sealing members of the valve ports 20*a*, 20*b* between a closed position, which closes the fluid channel 18 between the inlet port 14 and the outlet port 16 of the valve body 12, and an opened position.

The illustrative valve assembly 10 may include a characterized port defined between the inlet port 14 and the outlet port 16. A characterized port, when provided, may be any port (e.g., a fluid valve port 20 or other port or restriction through which the fluid channel 18 may travel) at or across which an analysis may be performed on a fluid flowing therethrough. For example, if a flow resistance of a valve port 20 is known over a range of travel of the valve sealing member, the one of the one or more gas valve ports 20 may be considered the characterized port. As such, and in some cases, the characterized port may be a port 20 having the valve sealing member configured to be in an opened position and/or in a closed position. Alternatively, or in addition, a characterized port may not correspond to a gas valve port 20 having a valve sealing member. Rather, the characterized port may be any constriction or feature across which a pressure drop may be measured and/or a flow rate may be determined.

The illustrative gas valve assembly 10 of FIGS. 2-4 is an example of a gas safety shutoff valve, or double-block valve. In some cases, however, it is contemplated that the gas valve assembly 10 may have a single valve sealing member, or three or more valve sealing members in series or parallel, as desired. Further, in some cases the gas valve assembly 10 may be in communication with additional gas shutoff valve or double-block valves that are positioned in parallel and/or in series with the gas valve assembly 10. The gas valve assembly 10 may include a modulating gas valve, but this is not required.

Figure 5:
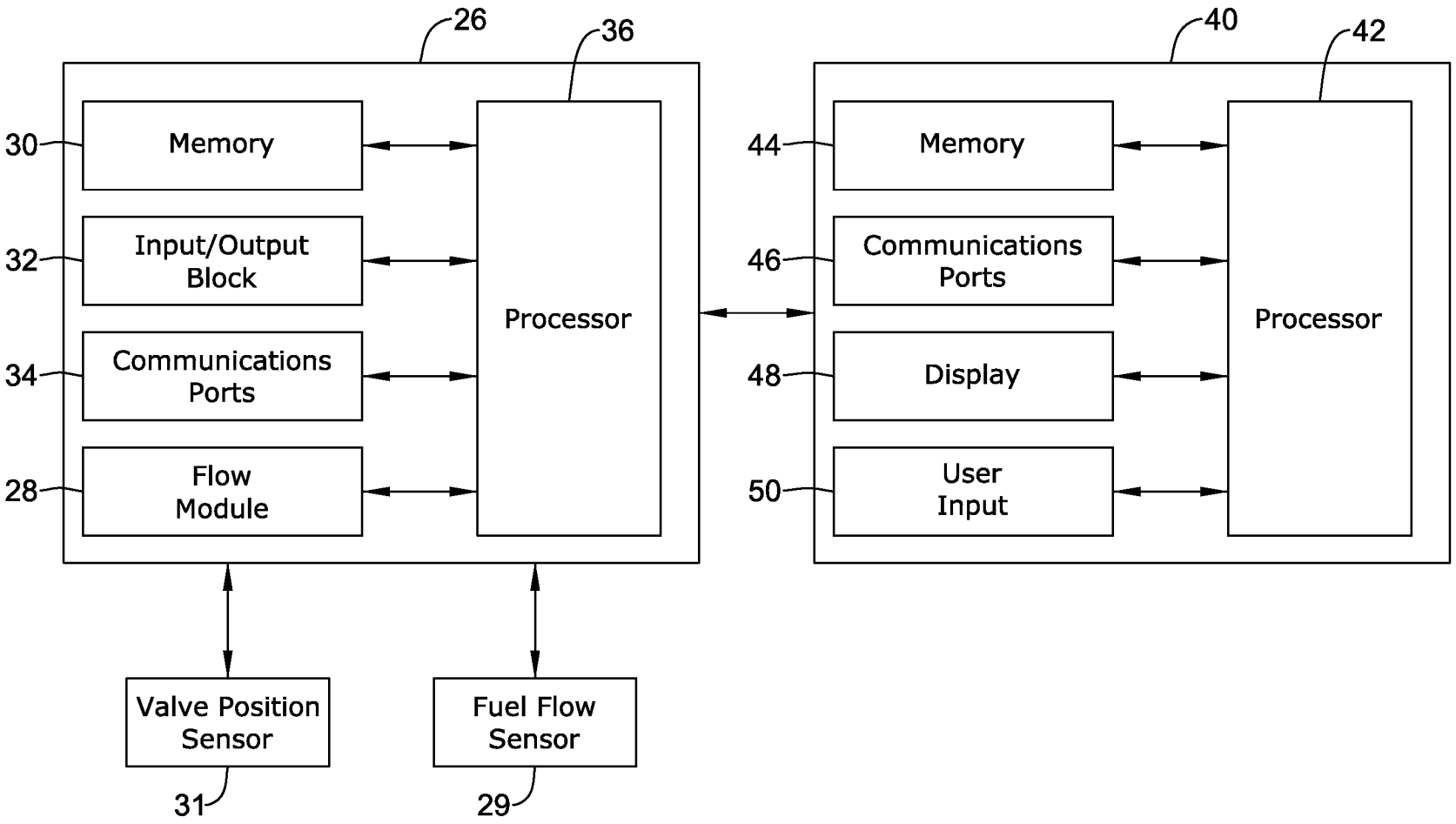
FIG. 5 is a schematic block diagram of an illustrative valve controller in communication with an illustrative external device.

The gas valve assembly 10 may include and/or may otherwise be in communication with a flow module (see, for example, a flow module 28 shown as part of the valve controller 26 in FIG. 5) for sensing one or more parameters of a fluid flowing through fluid channel 18, and in some cases, determining a measure related to a gas mass flow rate of the fluid flowing through the fluid channel 18. In some instances, the flow module may include a pressure block or pressure sensor assembly (e.g., the pressure sensor assembly 24 discussed herein and/or other suitable pressure sensor assemblies), a flow rate sensor (e.g., a flow rate sensor using an anemometer, a differential pressure sensor with upstream and downstream pressure taps, and/or other suitable flow rate sensor), a temperature sensor, a valve member position sensor, and/or the valve controller 26, among other assemblies, sensors and systems for sensing, monitoring and/or analyzing parameters of a fluid flowing through fluid channel 18. The flow module may be a part of the valve controller 26, as shown in FIG. 5, and/or otherwise, may be in communication with the valve controller 26.

It is contemplated that the valve controller 26 may be physically secured or coupled to, or secured or coupled relative to, the valve body 12 (as shown in FIG. 4). The valve controller 26 may be configured to control and/or monitor a position or state (e.g., an open position and/or a closed position) of the valve sealing members of the valve ports 20 and/or to perform other functions and analyses, as desired. In some cases, the valve controller 26 may be configured to close or open gas valve member(s) (e.g., valve sealing member(s)) on its own volition, in response to control signals or commands from other systems or appliances (e.g., a system level controller, a central building controller, or a combustion appliance controller 40), and/or in response to received measures related to sensed parameters (e.g., sensed flow through the fluid channel 18, sensed pressures upstream, intermediate, and/or downstream of the characterized valve port(s), sensed differential pressures across the characterized valve port(s), temperature sensed upstream, intermediate, and/or downstream of the characterized valve port(s), sensed combustion constituents in exhaust, and/or in response to other measures, as desired). In one example, the valve controller 26 may be configured to close and/or open gas valve member(s) in response to determining or receiving a burner load (e.g. firing rate) control signal or command from a system controller, a building level controller, and/or an appliance controller 40 (e.g. burner controller) to control a rate of flow of gas through the valve assembly 10 and to a downstream combustion appliance to achieve a desired A/F ratio at the commanded burner load.

FIG. 5 is a schematic block diagram of an illustrative valve controller 26 in communication with a combustion appliance controller 40. The illustrative valve controller 26 may include a processor or controller 36 (e.g., microcontroller and/or other suitable processor or controller). The valve controller 26 may be adapted or configured to operate in accordance with an algorithm that controls or at least partially controls portions of the valve assembly 10. The valve controller 26 may include a memory 30 that may be considered as being electrically connected to the processor 36. The memory 30 may be used to store any desired information, such as control algorithms, set points, A/F ratio versus burner load firing rate tables or curves, expected mass flow rates based on valve member positions tables or curves, tables or curves relating flow rates and valve member positions to an upstream pressure, and the like. The processor 36 may store information within the memory 30 and may subsequently retrieved the stored information. The memory 30 may be any suitable type of storage device, such as RAM, ROM, EPROM, a flash drive, a hard drive, and the like. Further, although not depicted in FIG. 5, the valve controller 26 may include a user interface having display and/or user input features.

The valve controller 26 may include an input/output block (I/O block) 32 having a number of wire terminals for connecting one or more wires from the valve assembly 10 and/or a combustion appliance controller 40. While the term I/O may imply both input and output, it is intended to include input only, output only, as well as both input and output. The I/O block 32 may be used to communicate one or more signals to and/or from the valve assembly 10 and/or the combustion appliance controller 40. The valve controller 26 may have any number of wire terminals for accepting connections from the valve assembly 10 and/or combustion appliance. How many and which of the wire terminals are actually used at a particular installation may depend on the particular configuration of the valve assembly 10 and/or the combustion appliance controller 40.

In some cases, as illustrated, the valve controller 26 may include a communications or data port 34. The communications or data ports 34 may be configured to communicate with the processor 36 and/or the I/O block 32 and may, if desired, be used to upload information to the processor 36, download information from the processor 36, provide commands to the processor 36, send commands from the processor 36, and/or perform any other suitable task. The communication port 34 may be a wireless port such as a Bluetooth™ port or any other wireless protocol. In some cases, the communication port 34 may be a wired port such as a serial port, a parallel port, a CATS port, a USB (universal serial bus) port, or the like. In some instances, the communication port 34 may be a USB port and may be used to download and/or upload information from a USB flash drive. Other storage devices may also be employed, as desired, and may be in communication with the processor 36 through the communication port 34.

It is contemplated that the valve controller 26 may include or otherwise be in communication with a flow module 28, which may utilize a suitable type of sensor to facilitate determining a measure related to a flow rate of a fluid through the fluid channel 18. The flow module 28 may include, for example, a flow rate sensor (e.g., a flow rate sensor using an anemometer, a differential pressure sensor with upstream and downstream pressure taps, and/or other suitable flow rate sensor), one or more pressure sensors, a valve position sensor, and/or other suitable type of sensor, suitable for use in determining the current flow rate of fluid through the fluid channel 18. In one particular example, the valve controller 26 may be configured to monitor a differential pressure across a characterized port based on measures from the flow module 28, and in some cases, a position of one or more valve sealing members 22 of the gas valve assembly 10. This information may be used by the flow module 28 and/or the valve controller 26 to determine and monitor the flow rate of fluid (e.g., liquid or gas) passing through the fluid channel 18. In some cases, the valve controller 26 may determine a measure that is related to a gas flow rate through the fluid channel 18 based, at least in part, on the measure that is related to the pressure drop across the characterized port along with a pre-stored relationships (e.g. stored in memory 30 of the valve controller 26) between sensed pressure, pressure drops, valve position (e.g., valve member 22 position), gas flow rates, and/or burner load. The memory 30 may be a part of the valve controller 26 and more specifically part of the flow module 28, as desired.

In some cases, relationships stored in memory may be in table form, but this is not required. One example of a table may define a relationship between a sensed pressure drop across a characterized port of the valve assembly 10 and a fuel flow rate through the fluid channel 18. In some cases, the table may include other sensed parameters such as temperature, gas inlet pressure and/or other sensed parameters to further refine the relationship. In another example, a table may define a relationship between a sensed or determined position of the valve sealing member and a fuel flow rate through the fluid channel 18. In another example, a table may define a relationship between a sensed flow rate, temperature, inlet pressure and/or other sensed parameters and a flow rate through the fluid channel 18. These are just examples.

In some cases, a fuel flow sensor 29 may be separate from the flow module 28 and/or utilized as an alternative to the flow module 28 of the valve controller 26. The fuel flow sensor 29 may be configured to sense a measure related to a mass flow rate of fuel through the fluid channel 18. In this instances, the valve controller 26 may utilize an output from the fuel flow sensor 29 and/or signals from the flow module 28 to determine a flow rate of fuel through the fluid channel 18.

A valve position sensor 31 may be in communication with the valve controller 26. Although the valve position sensor 31 is depicted in FIG. 5 as being separate from the valve controller 26, the valve position sensor 31 may be a counter within the valve controller 26 for a stepper motor actuator and/or may be at least partially incorporated into the valve controller 26. Alternatively or in addition, the valve position sensor 31 may be a hall-effect sensor, an optical sensor, or other suitable sensor configured to sense a measure related to a position of a valve member 22 of the valve assembly 10. The position of the valve may be used to determine a flow rate of fuel through the fluid channel 18. In some cases, an inlet fuel pressure, fuel temperature, and/or other sensed parameters may be used to further refine the determined flow rate of fuel through the fluid channel 18.

The memory 30, which in some cases may be part of valve controller 26, may be configured to record data related to sensed pressures, sensed differential pressures, sensed temperatures, and/or other measures sensed by sensors of the flow module 28 and/or other suitable sensors. The valve controller 26 may access this data, and in some cases, communicate (e.g., through a wired or wireless communication link) the data and/or analyses of the data to other systems (e.g., a system level or central building control). The memory 30 and/or other memory may be programmed and/or developed to contain software to affect one or more of the configurations described herein.

The combustion appliance controller device 40 may be in communication with the processor 36 of the valve controller 26 through, for example, the communication port 34 or other suitable connection to facilitate calibration procedures and/or programming of the valve controller 26. The valve controller 26 may be in wired or wireless communication with the combustion appliance controller 40. The combustion appliance controller 40 may be a computing device separate from the valve assembly 10. In some cases, the combustion appliance controller 40 may include a human-machine interface (HMI). In some cases, the combustion appliance controller 40 may be a personal computer, tablet computer, smart phone, laptop computer, or other suitable computing device as desired.

The combustion appliance controller 40 may include a processor 42 and memory 44 connected to the processor 42. The memory 44 may be used to store any desired information, such as a setup wizard, software programs, control algorithms, set points, thresholds, and the like. The processor 42 may store information within the memory 44 and may subsequently retrieve the stored information. The memory 44 may be any suitable type of storage device, such as RAM, ROM, EPROM, a flash drive, a hard drive, and the like.

In some cases, as illustrated, the combustion appliance controller 40 may include a communications or data port 46. The communication ports 46 may be configured to communicate with the processor 42 and may, if desired, be used to either upload information to the processor 42, download information from the processor 42, provide commands to the processor 36, send commands from the processor 36, and/or perform any other suitable task. The communication port 46 may be a wireless port such as a Bluetooth™ port or any other wireless protocol. In some cases, the communication port 46 may be a wired port such as a serial port, a parallel port, a CATS port, a USB (universal serial bus) port, or the like. In some instances, the communication port 46 may be a USB port and may be used to download and/or upload information from a USB flash drive. Other storage devices may also be employed, as desired. In some cases, the combustion appliance controller 40 may be in communication with the processor 36 of the valve controller 26 to facilitate programming procedures and/or other suitable procedures, as desired.

In some cases, the combustion appliance controller 40 may include a display 48. The display 48 may be housed by the combustion appliance controller 40, may be a standalone display, and/or may be part of a personal computer, tablet computer, smart phone, and/or laptop computer. In some instances, the combustion appliance controller 40 may include a user input 50 for receiving a user input from a user. For example, the user input may include a keyboard, mouse, actuatable buttons, a touchscreen display, and/or other user input mechanism. These are just examples.

Figure 6:
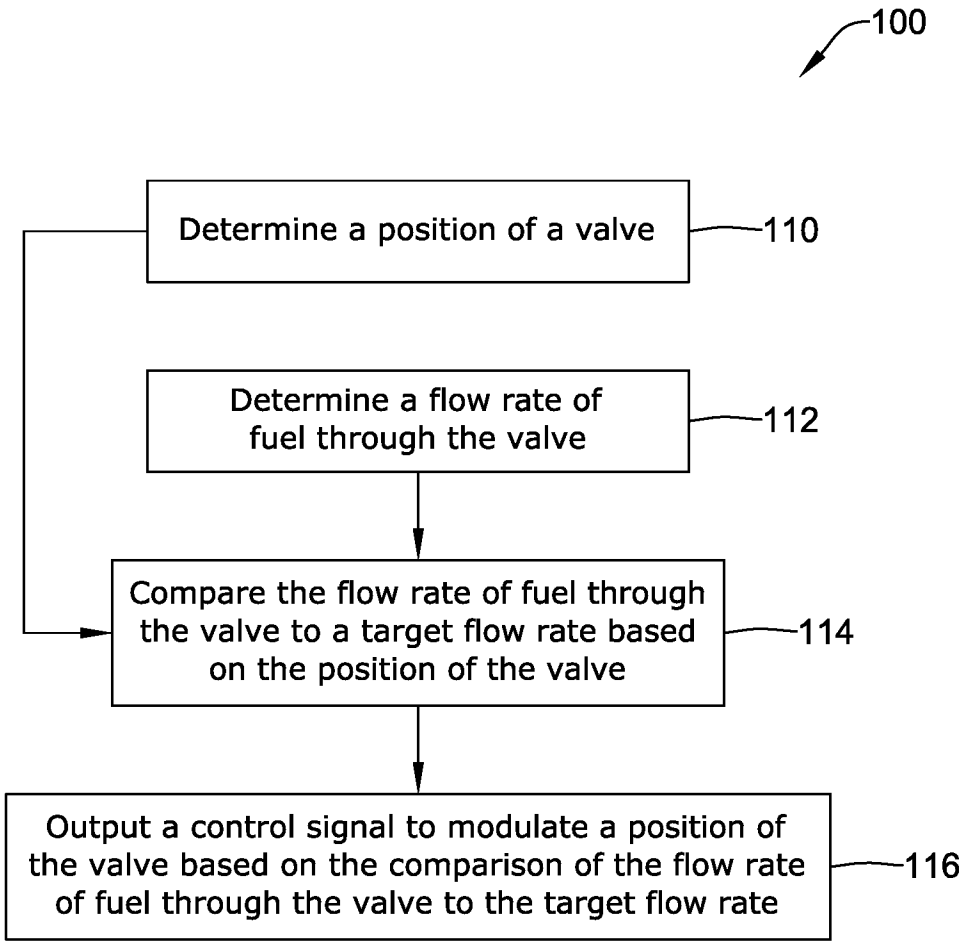
FIG. 6 is a schematic flow diagram depicting an illustrative method for controlling a valve position based on a current valve position and a flow rate of fluid through the valve.

FIG. 6 depicts a schematic flow diagram of an illustrative method 100 for controlling a flow of fluid through a modulating valve. In some cases, the method of FIG. 6 may be used to control a flow of gas to a burner of a combustion appliance, but this is not required in all cases. The illustrative method 100 may include determining 110 a position of a gas valve member (e.g., the gas valve member 22 or other suitable valve member). The positions of the gas valve member may be a fully closed position, a fully opened position, or one or more intermediate positions between the fully closed position and the fully opened position. The position of the gas valve member may be determined in any suitable manner. In one example, when the position of the gas valve member is modulated through the use of a stepper motor (e.g., the stepper motor 94 or other suitable stepper motor), a valve controller (e.g., the valve controller 26) or other controller (e.g., the combustion appliance controller) may determine a position of the gas valve member based on the control signals sent to the stepper motor or through a step counter associated with the stepper motor. In some cases, one or more position sensors may be in communication with the valve controller and may send a signal to the valve controller indicating a sensed position of the gas valve member. Such position sensors may sense a position of the gas valve member through Hall-effect sensing, optical sensing, and/or other suitable sensing techniques.

In some cases, the valve controller may command the actuator to drive the gas valve member to a position that is based on a combustion appliance burner load (e.g. from the combustion appliance controller 40) to achieve an expected gas flow rate through the valve and to a combustion chamber of a combustion appliance. This is one application.

The illustrative method 100 further includes determining 112 a flow rate of fluid (e.g., fuel or other fluid) through the fluid channel of the gas valve (e.g., the fluid path or fluid channel 18 or other suitable fluid path or channel). A flow rate of fluid across the valve member may be determined by the valve controller or other controller using measurements from a mass flow rate sensor, measurements of a differential pressure across the valve member, measurements of pressure upstream or downstream of the valve member, and/or one or more other suitable measurements. In some cases, one or more pressure sensors or flow rate sensors may be located in a flow module (e.g., the flow module 28 or other suitable flow module) and a flow rate of the fluid across the gas valve member may be determined by the valve controller from a measure related to a flow rate of the fluid passing through the flow module that is sensed by pressure sensors and/or flow rate sensors of the flow module.

The determined flow rate of the gas through the fluid channel of the gas valve may be compared 114 to a target or expected flow rate. In some cases, the target or expected flow rate may be identified by the valve controller or other controller based on the position of the valve member and/or based on a target flow rate needed to achieve a desired A/F ratio at a given burner load of a combustion appliance. The valve controller or other controller may include (e.g., store in memory) a relationship between a valve position and/or burner load and expected fluid flow rates across the gas valve member, and the valve controller or other controller may compare 114 the identified target or expected flow rate to the determined flow rate of fluid through the valve.

Based on the comparison of the determined flow rate of fluid through the valve member to the target or expected flow rate, the valve controller or other controller may output 116 a control signal from the valve controller or other controller to a valve actuator (e.g., the stepper motor 94, solenoid actuator 96, servo actuator 98, and/or other suitable valve actuators) to modulate, or to have a valve actuator modulate, a position of the valve member so as to achieve the target flow rate. In one example, if the comparison of the determined flow rate of fluid through the gas valve member is within a threshold difference of the target or expected flow rate of fluid across the valve member, the control signal may instruct the valve actuator to maintain a current position of the valve member. In this example, if the comparison of the determined flow rate of fluid through the valve member reaches and/or goes beyond the threshold difference, the control signal may instruct the valve actuator to adjust or modulate the current position of the valve member so as to achieve the target flow rate.

In some cases, when the determined flow rate of fluid through the gas valve member goes below a first threshold, but has not gone beyond a predetermined minimum flow rate threshold, the control signal may instruct the valve actuator to adjust or modulate a current position of the valve member to a fully opened position to at least meet the requirements for a partial burner load (less than the burner load called for by, for example, the combustion appliance controller 40). Similarly, when the determined flow rate of fluid through the valve member goes above a second threshold, but has not gone beyond a predetermined maximum flow rate threshold, the control signal may instruct the valve actuator to adjust or modulate a current position of the valve member to an intermediate position that meets the current burner load.

Figure 7:
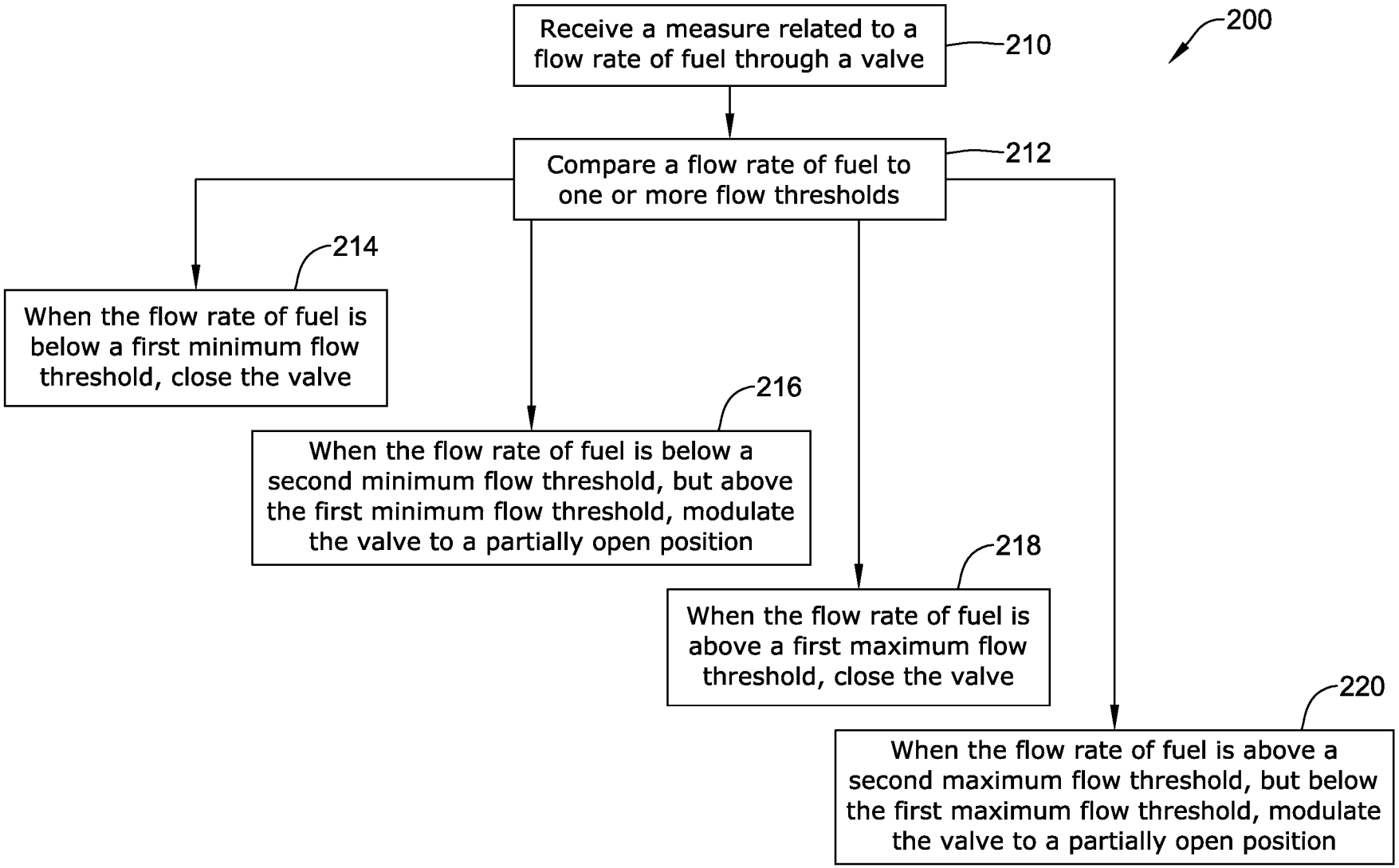
FIG. 7 is a schematic flow diagram depicting an illustrative method for controlling a valve position based on a flow rate of fluid through a valve relative to one or more threshold values.

FIG. 7 depicts a schematic flow diagram of an illustrative method 200 of modulating a valve member position based on a determined flow rate of fluid (e.g., fuel or other suitable fluid) across a valve member (e.g., the gas valve member 22 or other suitable valve member). Similar to method 100 discussed with respect to FIG. 6, the valve controller (e.g., the valve controller 26) or other controller (e.g., the combustion appliance controller 40) may receive 210 a measure related to a flow rate of fluid through or across the valve member (e.g., a flow rate of fluid through or across the valve member, a differential pressure across the valve member, a pressure upstream of the valve member, a pressure downstream of the valve member, and/or one or more other measures related to a flow rate of fluid through or across the valve member) and compares 212 the flow rate of fluid through or across the valve member (e.g., where the flow rate of fluid through or across the valve member may be determined based on the received measure related to a flow rate of fluid) to one or more thresholds. In some cases, comparing 212 the determined flow rate of fluid to a threshold may include comparing a difference between the determined flow rate of fluid or a measure related thereto to a target or an expected flow rate of fluid or measure related thereto to one or more thresholds (e.g., similar to as discussed with respect to the comparing 114 of the method 100) and/or directly comparing the determined flow rate of fluid or measure related thereto to one or more thresholds.

In one example, the determined flow rate of fluid or measure related thereto may be compared to four thresholds, which may include a first minimum flow threshold, a second minimum flow threshold, a first maximum flow threshold, and a second maximum flow threshold. In this example, when the flow rate of fluid or measure related thereto falls below the first minimum flow threshold, the valve controller or other controller may identify a first condition and move 214 the valve member to a fully closed position to shut off the flow of fluid (e.g., to shut off a burner of a combustion appliance by preventing fuel from reaching the burner) by sending a control signal directly or indirectly to a valve actuator (e.g., the stepper motor 94, the solenoid actuator 96, the servo actuator 98, and/or other suitable valve actuator). Alternatively or in addition, when the first condition is identified, the controller may send a signal to a valve actuator associated with a different valve member (e.g., a valve member of a different or additional safety shut off valve or other suitable valve member) in series with the other valve member to have the different valve member moved to a closed position to shut off the flow of fluid. When the flow rate of fluid or measure related thereto falls below the second minimum flow threshold but has not gone below the first minimum flow threshold, the valve controller or other controller may identify a second condition and modulate 216 the valve member to a position to allow the flow of fluid to continue flowing across valve member (e.g., to supply a burner of a combustion appliance with a fuel flow that at least partially satisfies a modulating burner load) by sending a control signal directly or indirectly to the valve actuator. In some cases, such modulation of the valve member may attempt to meet the target fuel flow rate to meet the commanded burner load. However, if the target fuel flow rate cannot meet the commanded burner load with the valve member in the fully open position, the valve controller or other controller may modulate the valve member to the fully open position to at least meet the requirements for a partial burner load (less than the burner load called for by, for example, the combustion appliance controller 40).

When the flow rate of fluid or measure related thereto goes above the first maximum flow threshold, the valve controller or other controller may identify a third condition and move 218 the valve member to a fully closed position and/or send a signal to have a different valve member (e.g., a valve member of a different or additional safety shut off valve or other suitable valve member) moved to a closed position to shut off the flow of fluid (e.g., to shut off a burner of a combustion appliance by preventing fuel from reaching the burner) by sending a control signal directly or indirectly to a valve actuator. Alternatively or in addition, when the third condition is identified, the controller may send a signal to a valve actuator associated with a different valve member (e.g., a valve member of a different or additional safety shut off valve or other suitable valve member) in series with the other valve member to have the different valve member moved to a closed position to shut off the flow of fluid. When the flow rate of fluid or measure related thereto goes above the second maximum flow threshold but does not go above the first maximum flow threshold, the valve controller or other controller may identify a fourth condition and modulate 220 the valve member to a partially opened position (e.g., a position between fully opened and fully closed) in a manner that meets the burner load (the burner load called for by, for example, the combustion appliance controller 40). The valve member may be actuated to a more closed position than if the flow rate of fluid or measure related thereto were below the second maximum flow threshold.

Figure 8:
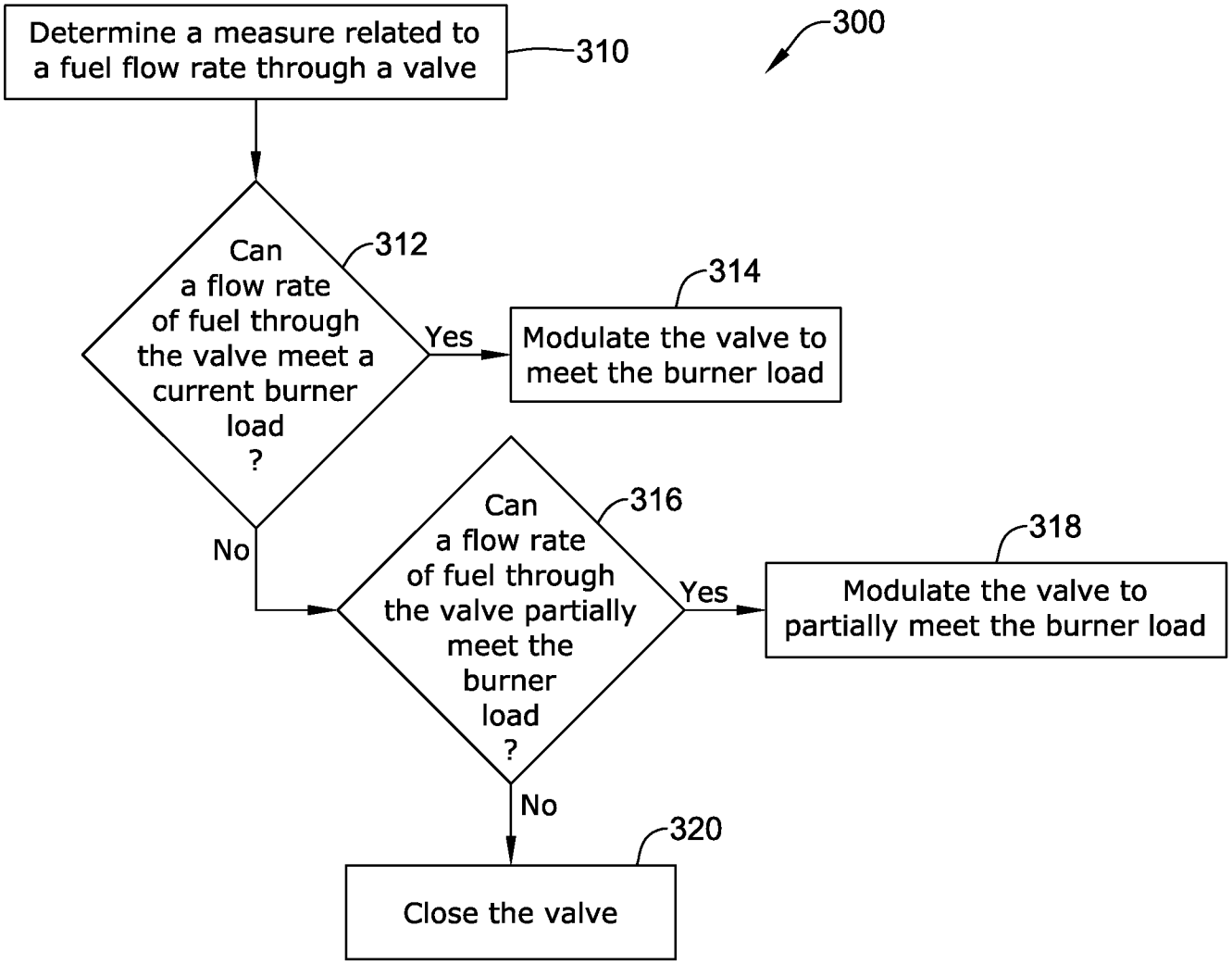
FIG. 8 is a schematic flow diagram depicting an illustrative method for controlling a valve position based on a flow rate of fluid through a valve and a current burner load of a combustion appliance.

FIG. 8 depicts a schematic flow diagram depicting an illustrative method 300 for controlling a modulating valve assembly (e.g., the valve assembly 10 or other suitable valve assembly) that is controlling a supply of fuel to a combustion appliance. The illustrative method 300 may include a valve controller (e.g., the valve controller 26) or other controller (e.g., the combustion appliance controller 40) determining 310 a measure related to a flow rate of fuel through or across a valve member (e.g., the gas valve member 22 or other suitable valve member) of the modulating valve assembly. Determining 310 a measure related to a flow rate of fuel through or across a valve member may include determining a flow rate of fuel through or across the valve member, a differential pressure across the valve member, a pressure upstream of the valve member, a pressure downstream of the valve member, and/or one or more other measures related to a flow rate of fuel through or across the valve member. In some cases, one or more flow rate sensors and/or pressure sensors in communication with the valve controller or other controller may be utilized to determine the measure related to the flow rate of fuel through or across the valve member.

Once a measure related to a fuel flow rate through or across the valve member has been determined, the valve controller or other controller may determine 312 whether a flow rate of fuel through the valve is sufficient to meet a current burner load of the combustion appliance using the determined measure related to the fuel flow rate through the valve member. If the flow rate of fuel through or across the valve member is sufficient to meet a current burner load, the valve controller or other controller may send a control signal to one or more valve actuators (e.g., the stepper motor 94, the solenoid actuator 96, the servo actuator 98, and/or other suitable valve actuator) to modulate 314 the valve member to achieve a target fuel flow rate to meet the current burner load.

If the flow rate of fuel through or across the valve member is insufficient to meet a current burner load, the valve controller or other controller may determine 316 whether a flow rate of fuel through or across the valve member can meet a partial burner load. If the flow rate of fuel through or across the valve member is sufficient to meet a partial burner load, the valve controller or other controller may send a control signal to one or more valve actuators to modulate 318 the valve member to a fully open position to at least partially meet the burner load. In some cases, when the valve controller or other controller modulates the valve member to a position that is configured to allow a fuel flow rate to only at least partially meet the current burner load, the valve controller or other controller may output a signal to a combustion appliance controller (e.g., the combustion appliance controller 40 or other suitable combustion appliance controller) that indicates the flow rate of fuel. The combustion appliance controller may then adjust the air flow (e.g. via fan 5) to achieve a desired air/fuel ratio to meet the partial burner load.

If the flow rate of fuel through or across the valve member is below a minimum flow rate threshold (e.g. such that reliable combustion could not be sustained), the valve controller or other controller may send a control signal to one or more valve actuators to move 320 the valve member to a fully closed position.

Figure 9:
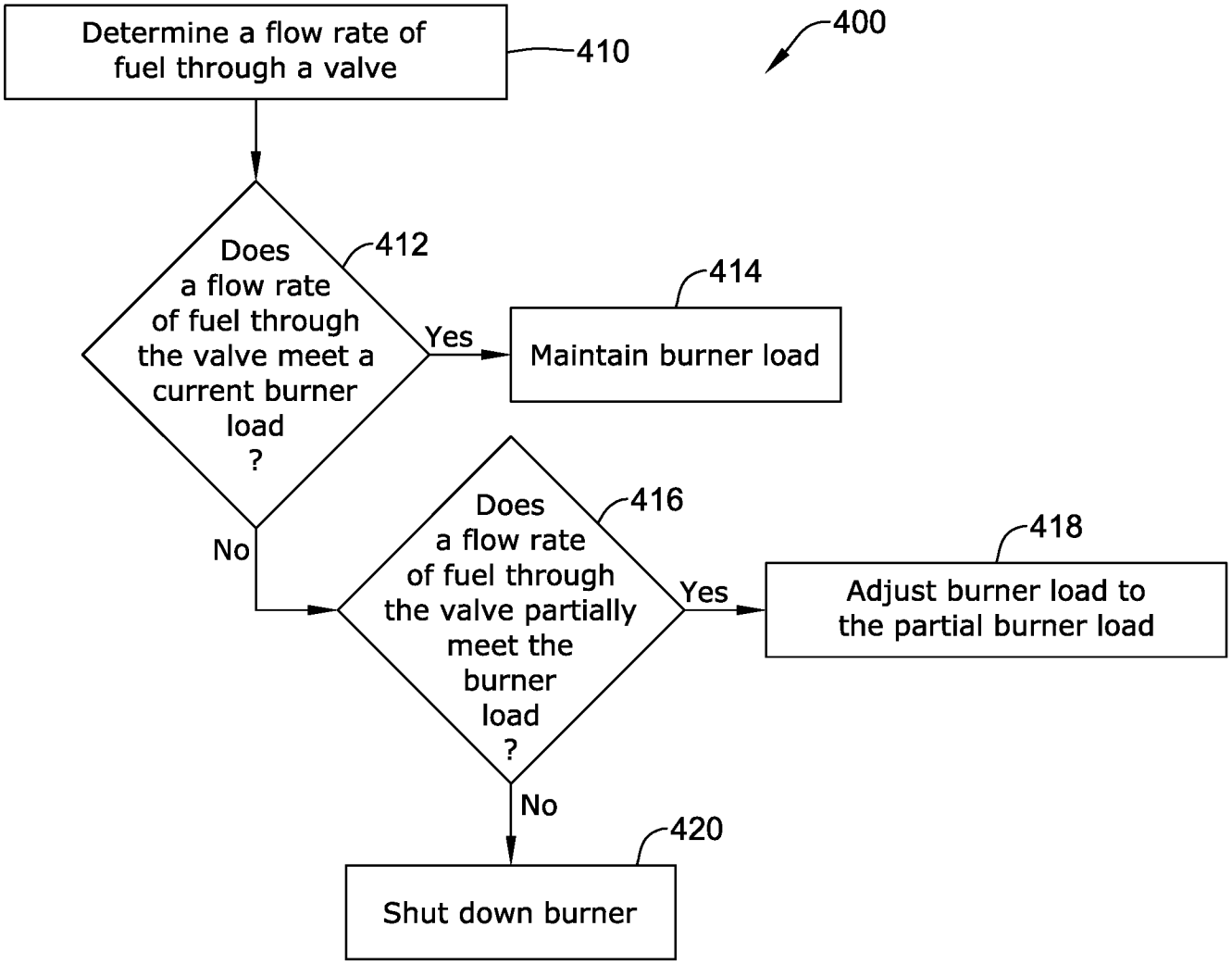
FIG. 9 is a schematic flow diagram depicting an illustrative method for controlling a burner load of a combustion appliance based on a flow rate of fluid through a valve and a current burner load of the combustion appliance.

FIG. 9 depicts a schematic flow diagram depicting an illustrative method 400 for controlling a burner load of a combustion appliance. The illustrative method 400 may include a valve controller (e.g., the valve controller 26) or other controller (e.g., the combustion appliance controller 40) determining 410 a flow rate of fuel through or across a valve member (e.g., the valve member 22 or other suitable valve member) that is controlling the flow rate of fuel to the combustion appliance. Determining 410 the flow rate of fuel through or across a valve member may include receiving measures of a flow rate of fuel through or across the valve member, a differential pressure across the valve member, a pressure upstream of the valve member, a pressure downstream of the valve member, and/or one or more other measures related to a flow rate of fuel through or across the valve member. One or more flow rate sensors and/or pressure sensors in communication with the valve controller or other controller may be utilized to determine the measure related to the flow rate of fuel through or across the valve member.

Once the fuel flow rate through or across the valve member has been determined, the valve controller or other controller may determine 412 whether the flow rate of fuel through the valve is sufficient to meet a current burner load of the combustion appliance using the determined flow rate of fuel through the valve member. If the flow rate of fuel through or across the valve member is sufficient to meet the current burner load, the valve controller or other controller may maintain 414 the current burner load. If the flow rate of fuel through or across the valve member is insufficient to meet a current burner load, the valve controller or other controller may determine 416 whether the flow rate of fuel through or across the valve member can meet a partial burner load. If the flow rate of fuel through or across the valve member is sufficient to meet the partial burner load, the valve controller or other controller may adjust 418 a burner load to the burner load which the fuel flow rate is sufficient to meet. In some cases, adjusting a burner load may include sending a control signal to a fan (e.g., the fan 5 or other suitable fan) to adjust its speed to a speed associated with the partial burner load. Such adjustment of a fan speed may facilitate achieving a desirable A/F ratio for the partial burner load that may be configured to achieve particular combustion constituents exiting in exhaust of the combustion appliance. If the flow rate of fuel through or across the valve member is below a minimum flow rate threshold (e.g. such that reliable combustion could not be sustained), the valve controller or other controller may shut down 420 a burner of the combustion appliance. Shutting down 420 the burner of the combustion appliance may including sending control signals to one or more valve actuators to move the valve member to a fully closed position.

Although the methods described herein may be described with respect to combustion appliances, the methods may be used in other fluid control applications. Additionally, unless specifically noted, various steps of the methods may be performed in one or more other orders than what is described above or depicted in the Figures. Further, the steps of the disclosed methods may be performed in an automated manner, in real time during operation of the combustion appliance. Alternatively or in addition, the disclosed processed and methods may be manually initiated.

It should be understood that this disclosure is, in many respects, only illustrative. The various individual elements discussed above may be arranged or configured in any combination thereof without exceeding the scope of the disclosure. Changes may be made in details, particularly in matters of shape, size, and arrangement of steps without exceeding the scope of the disclosure. The disclosure's scope is, of course, defined in the language in which the appended claims are expressed.

What is claimed is:

1. A gas valve for controlling a flow of gas to a burner of a combustion appliance to service a burner load, the gas valve comprising:

a valve body defining a gas flow path from an inlet to an outlet;

a valve situated in the gas flow path for modulating the gas flow through the gas flow path, the valve having a fully closed position, a fully open position and a plurality of intermediate positions between the fully closed position and the fully open position;

an actuator for moving the valve between the fully closed position, the fully open position and the plurality of intermediate positions;

a sensor for sensing a measure related to a gas inlet pressure of gas supplied to the gas valve;

a controller operatively coupled to the sensor and the actuator, the controller configured to:

identify a first condition that corresponds to when a flow of gas to the burner with the valve at the fully open position would fall below a first minimum flow threshold based at least in part on the measure related to a gas pressure of gas supplied to the gas valve sensed by the sensor, and when the first condition is identified, shut off gas flow to the burner;

identify a second condition that corresponds to when the flow of gas to the burner with the valve at the fully open position would fall below a second minimum flow threshold but above the first minimum flow threshold based at least in part on the measure related to a gas pressure of gas supplied to the gas valve sensed by the sensor, and when the second condition is identified, modulate the valve via the actuator to supply the burner with a gas flow that at least partially satisfies the modulating burner load;

identify a third condition that corresponds to when a flow of gas to the burner with the valve at a predetermined open position would fall above a first maximum flow threshold based at least in part on the measure related to a gas pressure of gas supplied to the gas valve sensed by the sensor, and when the third condition is identified, shut off gas flow to the burner; and identify a fourth condition that corresponds to when the flow of gas to the burner with the valve at the predetermined open position would fall above a second maximum flow threshold but below the first maximum flow threshold based at least in part on the measure related to a gas pressure of gas supplied to the gas valve sensed by the sensor, and when the fourth condition is identified, modulate the valve via the actuator to supply the burner with a gas flow that satisfies the modulating burner load.

2. The gas valve of claim 1, wherein the sensor includes a pressure sensor.

3. The gas valve of claim 1, wherein the sensor includes a flow sensor.

4. The gas valve of claim 3, wherein the measure related to a gas inlet pressure of gas supplied to the gas valve comprises a current gas flow rate detected by the flow sensor in combination with a current position of the valve.

5. The gas valve of claim 4, wherein the controller comprises a table that converts the current gas flow rate detected by the flow sensor in combination with the current position of the valve to the gas inlet pressure of gas supplied to the gas valve.

6. The gas valve of claim 1, wherein when the fourth condition is identified, the controller modulates the valve via the actuator to an intermediate position that is more toward the fully closed position than when the flow of gas to the burner with the valve at the predetermined open position falls below the second maximum flow threshold.

7. The gas valve of claim 1, wherein the actuator comprises a stepper motor.

8. A gas valve for controlling a flow of gas to a burner of a combustion appliance, the gas valve comprising:

a valve for controlling a flow of gas along a gas path;

a valve actuator for modulating a position of the valve and thus modulating the flow of gas along the gas path;

a flow sensor for sensing a measure related to a flow rate of the flow of gas along the gas path; and a controller configured to:

determine the position of the valve;

determine the flow rate of the flow of gas along the gas path based at least in part on the measure related to the flow rate of the flow of gas along the gas path received from the flow sensor; and output a control signal to modulate the position of the valve based on the position of the valve and the flow rate of the flow of gas along the gas path to attempt to provide a desired flow of gas to the burner to meet a current burner load;

wherein when the flow rate of the flow of gas along the gas path is not sufficient to provide the desired flow of gas to the burner with the position of the valve in a fully open position, but the flow rate of the flow of gas along the gas path is greater than a predetermined minimum flow of gas, the controller is configured to output a control signal that modulates the position of the valve to at least partially satisfy the current burner load; and wherein when the flow rate of the flow of gas along the gas path is higher than a predetermined maximum flow of gas with the position of the valve in a fully open position, but the flow rate of the flow of gas along the gas path is less than the predetermined maximum flow of gas with the position of the valve in a less than fully open position, the controller is configured to output a control signal that modulates the position of the valve to an intermediate position that meets the current burner load.

9. The gas valve of claim 8, wherein the flow sensor comprises one or more pressure sensors.

10. The gas valve of claim 8, wherein the flow sensor comprises a thermal anemometer.

11. The gas valve of claim 8, wherein the controller comprises a table that converts a current gas flow rate detected by the flow sensor in combination with a current position of the valve into a gas inlet pressure of gas supplied to the valve.

12. The gas valve of claim 8, wherein the valve actuator comprises a stepper motor.

13. A method for controlling a gas valve for supplying a flow of gas to a burner of a combustion appliance, the method comprising:

determining a measure related to a gas flow rate of gas passing through the modulating gas valve based on a signal from a sensor;

determining when a desired gas flow rate of gas can be provided by the gas valve to meet a current burner load of the combustion appliance, and when so, modulating the gas valve to meet the current burner load of the combustion appliance; and determining when a desired gas flow rate of gas can be provided by the gas valve to only partially meet the current burner load of the combustion appliance even with the gas valve in a fully open position while still providing at least a predetermined minimum gas flow rate to the burner, and when so, modulating the gas valve to partially meet the current burner load of the combustion appliance;

determining when a desired gas flow rate of gas can be provided by the gas valve to meet the current burner load of the combustion appliance but not while keeping the gas flow rate below a first predetermined maximum gas flow rate to the burner, and when so, modulating the gas valve to meet the current burner load of the combustion appliance; and determining when a desired gas flow rate of gas can be provided by the gas valve to only partially meet the current burner load of the combustion appliance even with the gas valve in a fully open position but not while still providing at least the predetermined minimum gas flow rate to the burner, and when so, modulating the gas valve to a fully closed position.

14. The method of claim 13, further comprising:

determining when a desired gas flow rate of gas can be provided by the gas valve to meet the current burner load of the combustion appliance but not while keeping the gas flow rate below the predetermined maximum gas flow rate to the burner, and when so, modulating the gas valve to a fully closed position.

15. The method of claim 13, wherein the sensor comprises a flow sensor.

16. The method of claim 13, wherein the sensor comprises a pressure sensor.

* * * * *